US007520094B2

(12) United States Patent
Davies

(10) Patent No.: US 7,520,094 B2
(45) Date of Patent: Apr. 21, 2009

(54) MULLION JOINT BETWEEN TWO FRAME MEMBERS OF A WINDOW OR DOOR FRAME

(75) Inventor: Laurecne W. Davies, Winnipeg (CA)

(73) Assignee: Omniglass Ltd., Winnipeg, Manitoba (CA)

( * ) Notice: Subject to any disclaimer, the term of this patent is extended or adjusted under 35 U.S.C. 154(b) by 43 days.

(21) Appl. No.: 11/558,531

(22) Filed: Nov. 10, 2006

(65) Prior Publication Data

US 2008/0110094 A1 May 15, 2008

(51) Int. Cl.
*E04B 1/04* (2006.01)
*E04B 3/00* (2006.01)
*E04B 2/00* (2006.01)

(52) U.S. Cl. ..... 52/204.1; 52/204.5; 52/205; 52/212; 52/208; 52/584.1; 52/591.5

(58) Field of Classification Search ..... 52/204.1, 52/204.5, 205, 212, 204.51, 208, 204.54, 52/204.55, 204.593, 204.67, 204.7, 582.1, 52/582.2, 584.1, 591.5
See application file for complete search history.

(56) References Cited

U.S. PATENT DOCUMENTS 3,340,663 A * 9/1967 Collard ..... 52/775
5,435,106 A * 7/1995 Garries et al. ..... 52/204.5
5,557,894 A * 9/1996 Card ..... 52/204.595
6,016,632 A * 1/2000 McGee et al. ..... 52/241
6,230,470 B1 * 5/2001 Kimmerle et al. ..... 52/762
6,519,907 B1 * 2/2003 Weissinger ..... 52/582.2
6,662,512 B2 * 12/2003 Westphal ..... 52/204.5
6,722,089 B2 * 4/2004 Budzinski ..... 52/204.5
D565,199 S * 3/2008 Westphal ..... D25/122
2002/0148178 A1 * 10/2002 Farag ..... 52/204.1
2003/0217523 A1 * 11/2003 Budzinski ..... 52/204.5
2005/0284046 A1 * 12/2005 Neal ..... 52/204.5

* cited by examiner

*Primary Examiner*—Richard E Chilcot, Jr.
*Assistant Examiner*—Mark R Wendell
(74) *Attorney, Agent, or Firm*—Adrian D. Battison; Ade & Company Inc.

(57) ABSTRACT

A mullion for a window frame is formed by two frame members back to back to form the mullion. The facing surfaces are connected by providing aligned first and second recesses therein where each of the recesses has a mouth at the which is narrower than a base and has a connecting member along the aligned recesses with a portion of the connecting member within each recess as a loose fit. Each connecting member has associated with it an insert member with an insert portion between the outer surfaces of the first and second frame members forcing the outer surfaces apart to tighten the connecting member and a cover portion covering a junction between the side surfaces.

13 Claims, 4 Drawing Sheets

40
30
35
17

36
37
33
34
60
39
31
38
67
50
65
66
53
62
51
63
31
55
56
52
33
34
20
30

MULLION JOINT BETWEEN TWO FRAME MEMBERS OF A WINDOW OR DOOR FRAME

This invention relates to a mullion joint between two members of a widow or door construction.

BACKGROUND OF THE INVENTION

Frames for windows or doors commonly comprise an outer peripheral frame which is entered into an opening in a wall. In some cases the frame includes a cross member which extends across from one side frame member to a second opposed side frame member and these cross members are known as mullions.

In some case the mullion is formed as a cross member separate from the peripheral frame which butts at its ends against the side frame members at their opposed positions.

In other cases the structure is formed by two separate frame portions each having four frame members arranged around an open interior where the frame members on one side are butted against one another to form the mullion.

It will be appreciated that such constructions can be used in the formation of windows and also commonly in the formation of patio doors which provide a similar mullion between a fixed glass pane on one side and a movable glass pane on the other side or between two sliding members.

In regard to window frame constructions, the arrangement can be used with fixed panes, sash frames and sliders and the different design arrangements to be used in these different constructions are well known to a person skilled in the art.

SUMMARY OF THE INVENTION

It is one object of the invention to provide a mullion joint between two members of a widow or door construction.

According to one aspect of the invention there is provided a window or door frame for placement in an opening to be filled in a wall comprising:

a first frame member for placement in the opening;

a second frame member for placement in the opening;

each of the first and second frame members having an inner surface for facing generally at right angles to a plane of the wall inwardly of the opening, an outer surface for facing generally at right angles to the plane of the wall and opposite to the inner surface, a first side surface for facing generally in a direction co-planar with the wall toward a window or door to be supported thereby and a second side surface for facing generally in a direction co-planar with the wall opposite to the front surface;

the first and second frame members being arranged outer surface to outer surface to form a mullion across the opening with the first side surfaces thereof generally coplanar and the second side surfaces thereof generally coplanar;

the outer surface of the first frame member having first and second recesses therein extending longitudinally of the first frame member with the first recess arranged adjacent the first side surface and the second recess arranged adjacent the second side surface;

the outer surface of the second frame member having first and second recesses therein extending longitudinally of the second frame member with the first recess arranged adjacent the first side surface and the second recess arranged adjacent the second side surface;

the first recess of the first frame member being aligned with the first recess of the second frame member and the second recess of the first frame member being aligned with the second recess of the second frame member;

each of the recesses having a mouth at the outer surface which is narrower than a portion of the recess spaced from the outer surface;

a first connecting member arranged to lie along the aligned first recesses with a portion of the first connecting member within the first recess of the first frame member and a portion of the first connecting member within the first recess of the second frame member;

the portions of the first connecting member being arranged to be wider than the respective mouth of the first recesses such that the first connecting member prevents the first and second frame members from being pulled apart;

the portions of the first connecting member being arranged to be shallower than the respective first recess so that the first connecting member is a loose fit in the first recesses when the first and second frame members are directly outer surface to outer surface;

a second connecting member arranged to lie along the aligned second recesses with a portion of the second connecting member within the recess of the first frame member and a portion of the first connecting member within the recess of the second frame member;

the portions of the second connecting member being arranged to be wider than the respective mouth of the second recesses such that the second connecting member prevents the first and second frame members from being pulled apart;

the portions of the second connecting member being arranged to be shallower than the respective second recess so that the second connecting member is a loose fit in the second recesses when the first and second frame members are directly outer surface to outer surface;

a first insert member for engagement with the first and second frame members on the first side surfaces thereof at a location thereon at the outer surfaces thereof;

the first insert member having an insert portion for insertion between the outer surfaces of the first and second frame members adjacent the first recesses thereof so as to force the outer surfaces apart and so as to pull the mouths of the first recesses into tight engagement with the respective portions of the first connecting member;

the first insert member having a cover portion covering a junction between the first side surfaces of the first and second frame members;

a second insert member for engagement with the first and second frame members on the second side surfaces thereof at a location thereon at the outer surfaces thereof;

the second insert member having an insert portion for insertion between the outer surfaces of the first and second frame members adjacent the second recesses thereof so as to force the outer surfaces apart and so as to pull the mouths of the second recesses into tight engagement with the respective portions of the second connecting member;

and the second insert member having a cover portion covering a junction between the second side surfaces of the first and second frame members.

Preferably a first bead of sealant is placed within the junction between the first side surfaces and covered by the first insert member and a second bead of sealant is placed within the junction between the second side surfaces and covered by the second insert member.

Preferably the insert portion of each of the first and second insert members is formed by a single longitudinal web with a wider bead on an end thereof remote from the cover portion.

As an alternative the insert portion of each of the first and second insert members may be formed by a pair of transversely spaced, longitudinal webs so as provide a spacing between the first and second frame members.

Preferably each of the connecting members has a channel along a face thereof adjacent a base of the respective recess.

Preferably the first connecting members has a channel along a face thereof adjacent the junction between the first side walls so as to receive therein an end of the insert portion of the first insert member.

Preferably the second connecting members has a channel along a face thereof adjacent the junction between the second side walls so as to receive therein an end of the insert portion of the second insert member.

Preferably each of the first recesses is spaced from the first side surfaces by a single wall of the frame member.

Preferably each of the second recesses is spaced from the second side surfaces by a single wall of the frame member.

Preferably the cover portion of the first insert member forms a flat strip lying flat against the first side surfaces.

Preferably the cover portion of the second insert member forms a flat strip lying flat against the side second surfaces.

Preferably the first and second frame members each comprise a length of a pultruded hollow profile.

Preferably the first frame member comprises a portion of a first frame defined by a plurality of frame members, each of the frame members having a first and a second recess in an outer surface thereof and wherein at least one of the frame members has the first recess thereof arranged to receive a nailing fin carried therein.

Preferably the second recess thereof is arranged to receive a sill plate carried therein.

BRIEF DESCRIPTION OF THE DRAWINGS

One embodiment of the invention will now be described in conjunction with the accompanying drawings in which:

FIG. 4 shows the construction before assembly and FIG. 5 shows the fixed construction after the insert member is inserted.

In the drawings like characters of reference indicate corresponding parts in the different figures.

DETAILED DESCRIPTION

Figure 3:
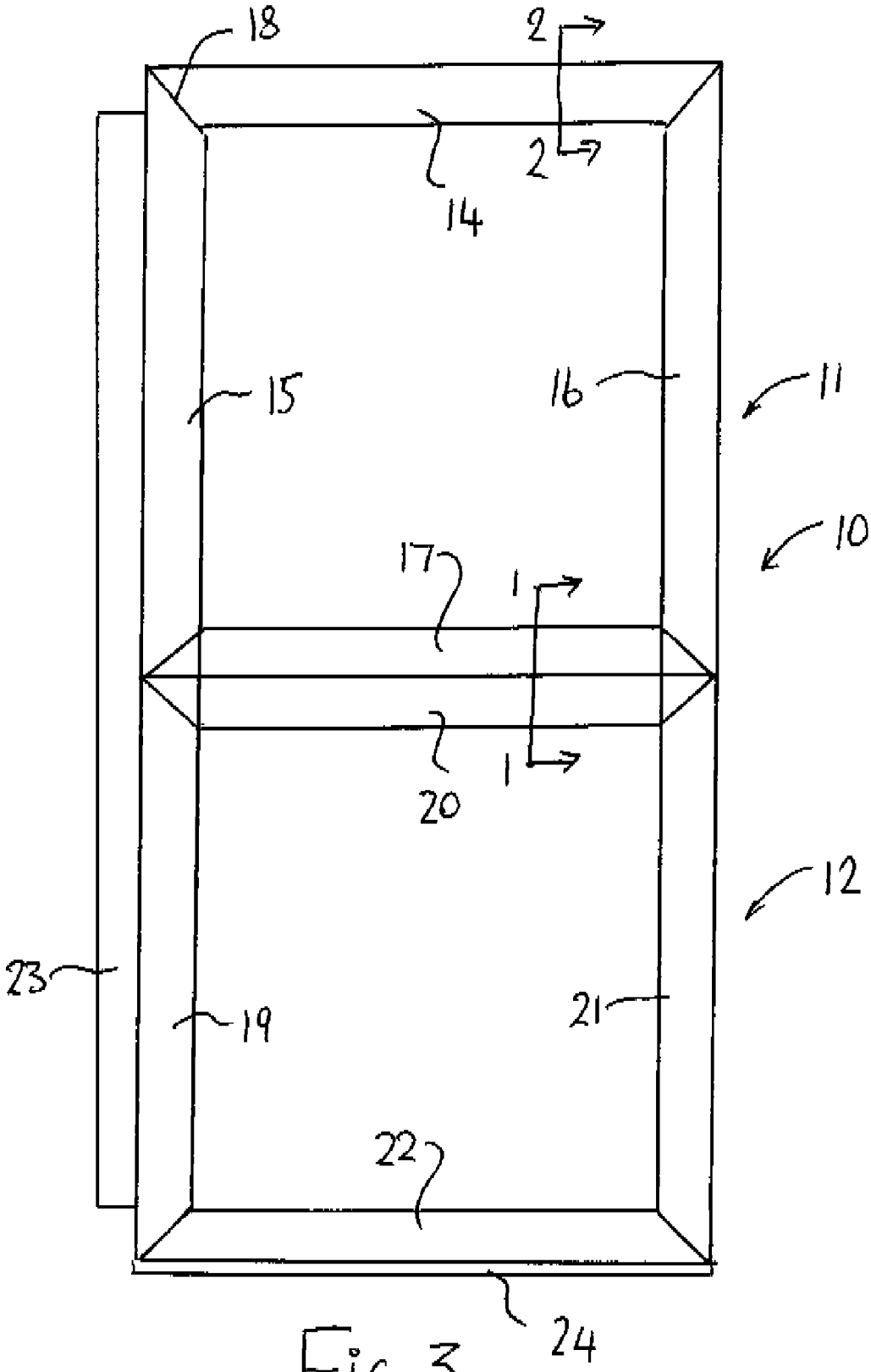
FIG. 3 is a front elevation of a window frame using the constructions of FIGS. 1 and 2.

In FIG. 3 is shown a window frame generally indicated at 10 which includes a first frame portion 11 and a second frame portion 12 which are connected together at a mullion 13. A first frame portion 11 includes frame members 14, 15, 16 and 17 where frame member 17 forms part of the mullion 13. These frame members are arranged end to end to form a rectangular structure. In the embodiment shown the joints are formed at mitre joints indicated at 18. However the joints may be butt joints which is well known to a person skilled in the art.

The frame portion 12 is formed by frame members 19, 20, 21 and 22 again arranged in a rectangular arrangement so that the frame member 20 butts with the frame member 17 to form the mullion.

Around the periphery is attached a nailing strip 23 which is inserted into a receiving a recess or groove as described in more detail hereinafter. A sill plate or finishing strip 24 is also attached along the edges of the frame. This nailing strip and the finishing plate are well known elements and provide the attachment of the frame structure to the opening into which the frame structure is inserted in the wall.

Figure 1:
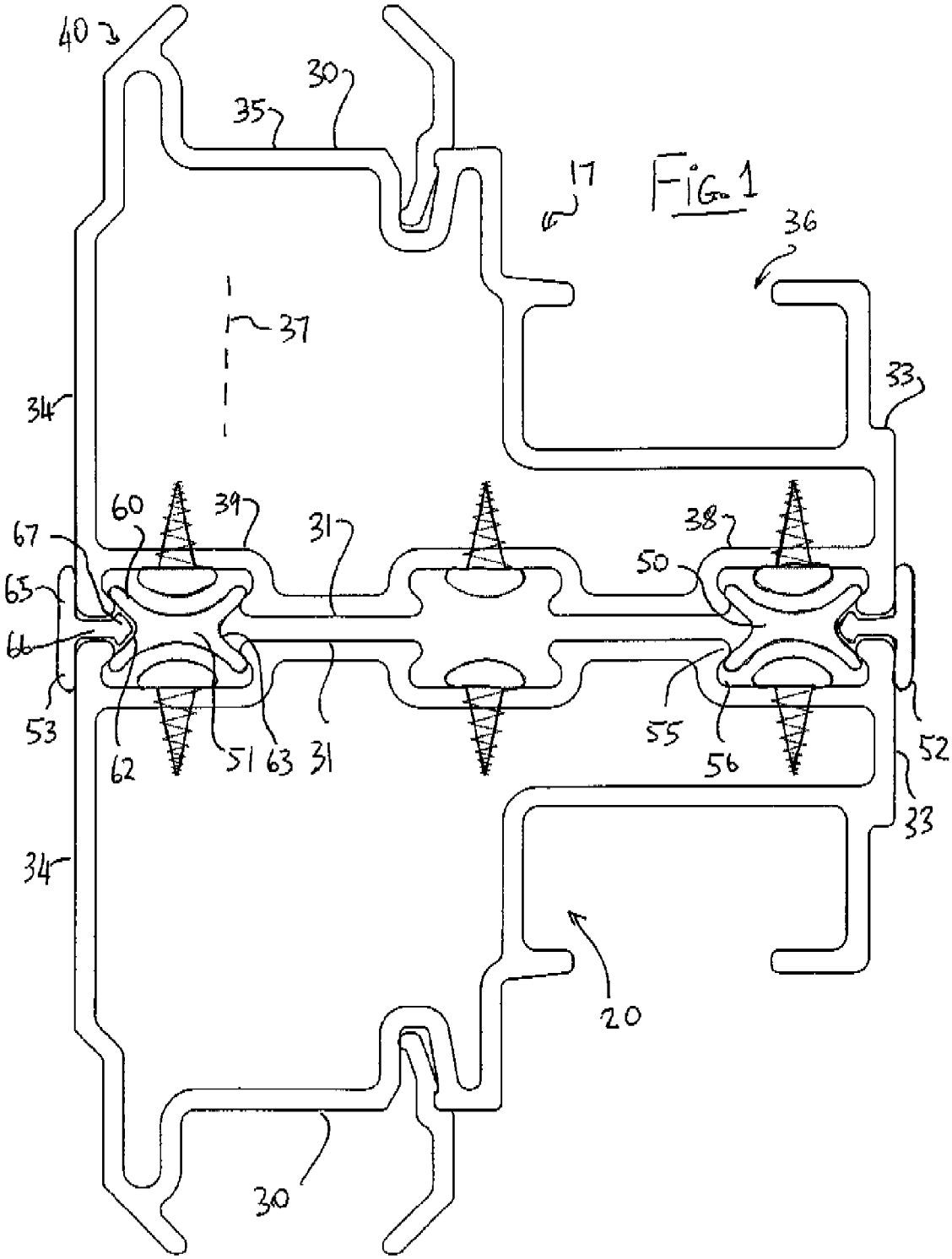
FIG. 1 is a cross sectional view taken along the lines 1-1 of FIG. 3 through two frame members connected to form a mullion of a window frame according to the present invention.

Turning now to FIG. 1, a cross section of FIG. 1 is shown in FIG. 3 at line 1-1 and provides a cross section at the mullion joint between the frame members 17 and 20.

For convenience of description, each of the frame members 17 and 20 has an inner surface 30 and an outer surface 31. These surfaces are described in respect of the opening so that the inner surfaces face inwardly into the opening between the frame members and the outer surface faces outwardly of the opening between the frame members. Both of these surfaces lie generally in a plane at right angles to the plane of the wall at the opening. It will be appreciated however that these surfaces maybe inclined relative to this plane since the surface 30 is structured and shaped to provide co-operation with the window to be inserted therein and hence it has portions which are inclined to the plane at right angles to the opening.

The frame members 17 and 20 also include a first side surface 33 and a second side surface 34. These lies generally in a common plane with the plane of the opening in the wall and define the surfaces which are the front surface and rear surface of the window frame when viewed from the interior of the building.

Thus the inner surface 30 includes a first portion 35 which is arranged for co-operation with a glazing panel or a sash frame (not shown). The surface 30 also includes a second portion 36 which is arranged for cooperation with a sash frame. It will be appreciated that the specific structure of the frame is merely exemplary and many different shapes and designs can be used and are well known to a person skilled in this art. The outer surface 31 is generally flat and at right angles to the plane 37 of the opening but includes two recesses 38 and 39 including a first recess 38 adjacent the first side wall 33 and a second recess 39 adjacent the second side surface 34. An optional intermediate recess 38A can be provided between the recesses 38 and 39. The surface 34 includes a glazing stop 40 which projects beyond the portion 35 of the inner wall 30 and provides an abutment for the sash frame or glazing panel.

Figure 2:
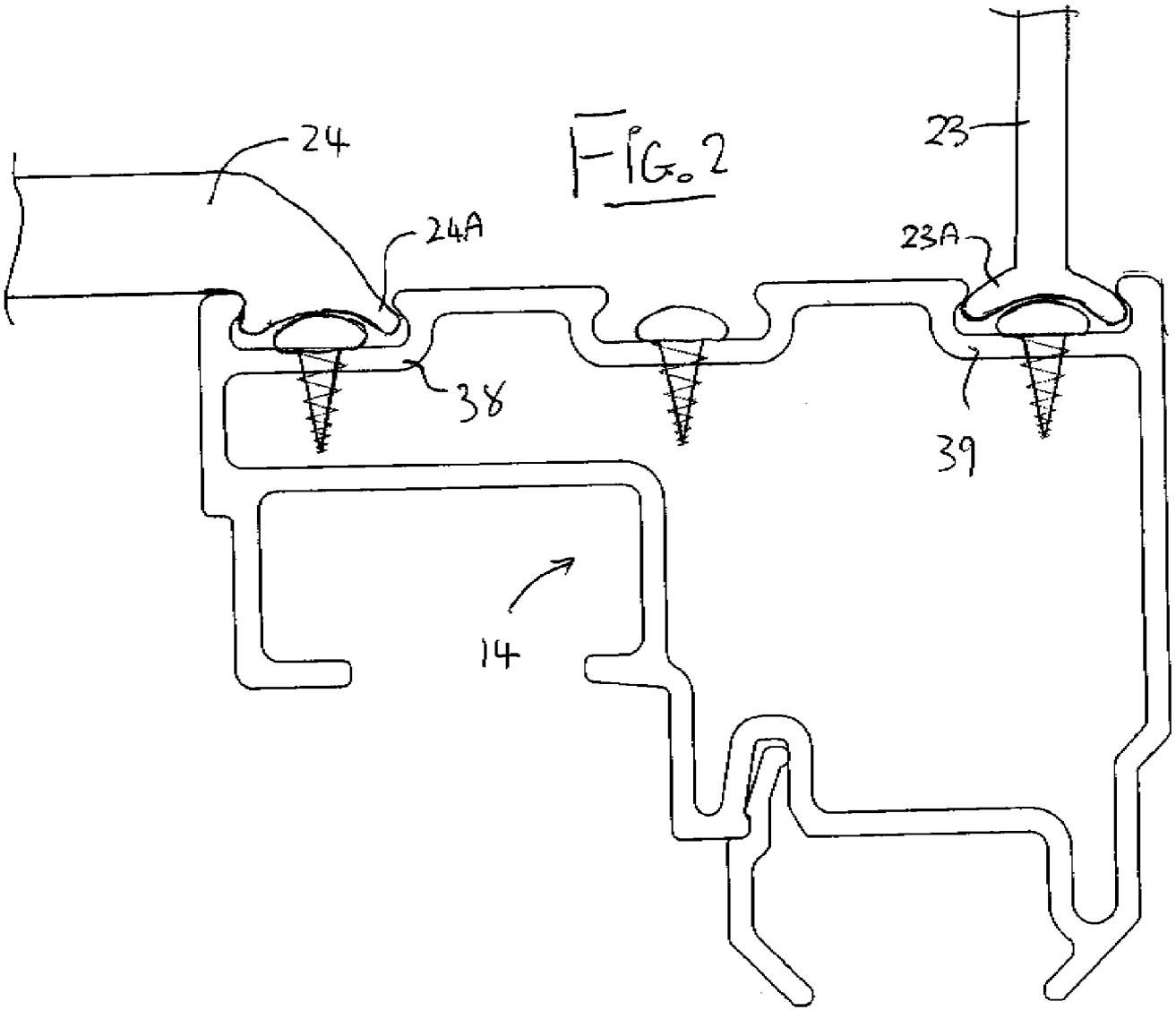
FIG. 2 is a cross sectional view through one frame member of the same construction as that of FIG. 1 taken along the lines 2-2 of FIG. 3 and thus spaced from the mullion and showing the use of the recesses of FIG. 1 to receive a nailing fin and a finishing plate.

The frame members 14 to 17 and 19 to 22 are all formed of the same cross section so that each can be cut to length from a profile formed to the shape shown in FIGS. 1 and 2.

The profile is preferably formed of a pultruded fiber reinforced resin material but can be formed from other materials including extruded vinyl and aluminium as is well known to a person skilled in the art. Each material has its own advantages and disadvantages, as again is well known to a person skilled in the art.

The frame members as shown in FIG. 3 include a wall defining the outer surface 31, a wall defining the inner surface 30 and two walls defining the first and second side surfaces 33 and 34. An additional central support wall can be provided between the inner and outer walls parallel to the first and second side surfaces to provide increased strength but in this design is omitted. Profiles of this type can be formed by pultrusion from fiber reinforced resin materials as is well known.

The frame members 17 and 20 are connected so that the outer surface of one is adjacent to the outer surface of the other. In this arrangement, of course, as the frame members are identical as being out from the same pultruded profile, with the outer surfaces adjacent and in alignment, the first side surfaces 33 lie in a common front plane and the second side surfaces 34 also lie in a common rear plane parallel to the front plane.

The frame members 17 and 20 are held in the back to back relationship by a connection provided by the recesses 38 and 39 together with connecting members 50 and 51 and insert members 52 and 53.

Thus there is provides a first recess 38 which is located at the first side surface 33. This recess is formed in the outer wall defining the outer surface 31. The recess thus extends into the body of the pultruded profile from the rear surface 31 and forms a mouth 55 and a base portion 56 recessed from that mouth. The base portion is wider than the mouth so as to form lips on each side of the mouth. The base portion is flat to define a wall parallel to the wall forming the surface 31. Each side of the recess is formed by a wall extending from the wall at the base to the wall of the outer surface 31. At the first side surface 33, this is formed by a single wall so that the recess is located immediately at the surface 33 and spaced from that surface only by the thickness of the wall.

The recess 39 is exactly symmetrical relative to the recess 38 except it is located at the second surface 34. Thus the second recess forms a symmetrical mouth and a symmetrical base portion with the recess being separated from the surface 34 again only by a single wall thickness.

The connecting member 51 is generally of X-shaped cross section. This forms therefore a portion 60 which is located in the recess 39. The connecting member has longitudinal groove 61 in the surface facing into the recess.

Figure 4:
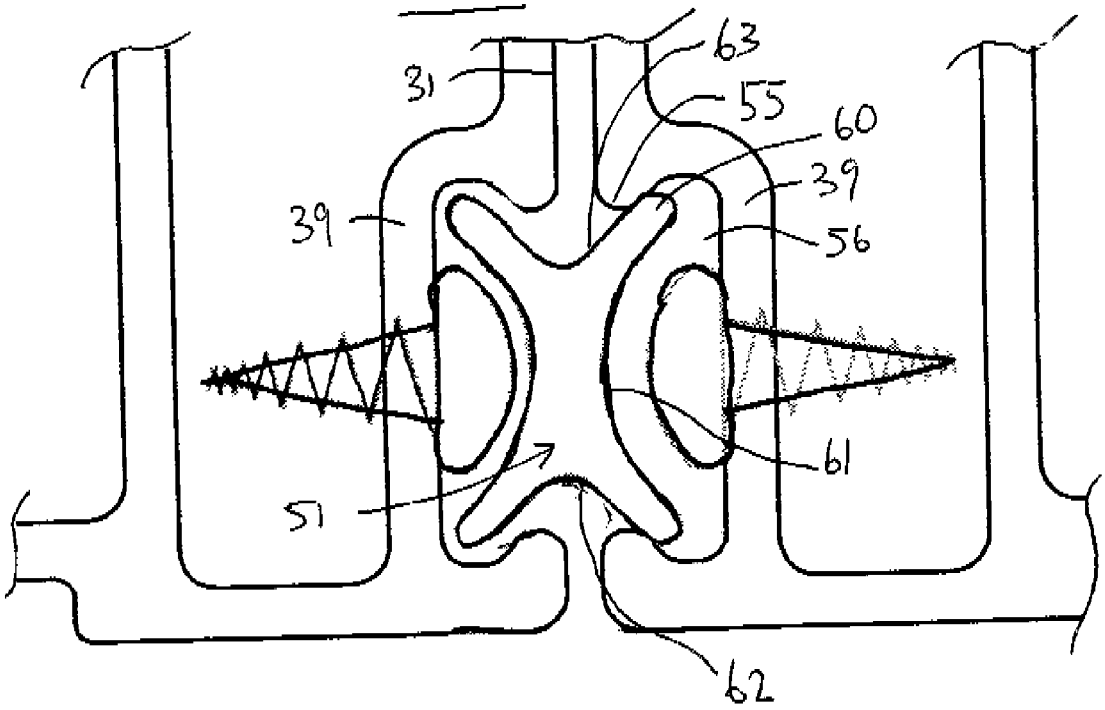
FIGS. 4 and 5 are cross sections similar to that of FIG. 1 on an enlarged scale showing the co-operation between the recesses and the connecting member together with the insert member to hold the frame members connected at the mullion, where

Also the connecting member has a longitudinal groove in each of its side edges indicated at 62 and 63. The connecting members are arranged relative to the recesses so that the portion thereof received within the recess is a loose fit between the base and the mouth of the recess. Thus as shown in FIG. 4, with the insert member 53 omitted, the connecting member 51 can be simply and easily received within the adjacent recesses since it is significantly smaller than the dimensions of the recesses together. With the outer surfaces 31 therefore butting or closely adjacent as shown, the connecting member 51 is free to slide along the interior of the two recesses with the insert portion thereof received within the recess and sliding along within the interior of the recess beneath the mouth. However the width of the portion 60 within the recess is greater than the width of the mouth 55 so that it cannot be simply pulled out by relative movement of the two frame members in the direction away from one another. In this way the connecting member can be simply slid into place as a free-sliding fit without any binding or tight engagement.

The insert members 52 and 53 are shaped with a flat cover portion 65 and a projecting flange portion 66. At the end of the projecting flange 66 is a bead 67. The flange 66 is at right angles to the flat cover portion 65.

Figure 5:
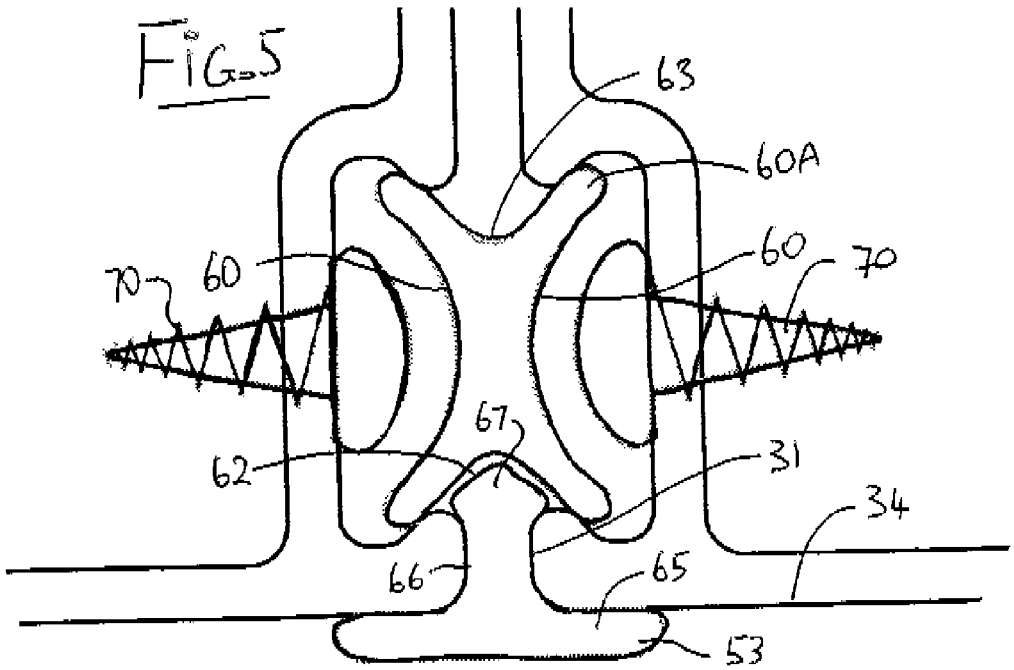

As shown in FIG. 4, the insert member 53 is omitted from the connection between the frame members 17 and 20 so that the connection is at this stage a loose fit provided simply by the connecting member 51. However the insert member can be pushed into place as shown in FIG. 5 between the surfaces 31 at the outer surfaces 34. Thus the flange 66 can slide between the edges of the frame members at the surfaces 34 with the bead 67 popping into place between those edges so as to enter the position inside the wall forming the outer surface 34. The bead 67 therefore extends into the groove 62 along the side of the X-shaped connecting member 51. The thickness of the flange 66 is selected so that it forces apart the surfaces 31 so that the mouth 55 engages the portion 60 of the connecting member within the recess an thus tightens onto the adjacent surface of the connecting member. As the connecting member is generally X-shaped, it forms two flange portions 60A each on a respective side of the groove 63 with each flange portion being slightly flexible. This flange portion abuts the inside surface of the lip of the mouth in a tight fit. In this way the insertion of the insert member and particularly its flange portion 66 between the frame members acts to tighten the connecting member into place within the two aligned recesses.

The insert member thus carries out two functions in that it forces apart the frame members to tighten the connecting member within the recesses and secondly it provides the cover portion 65 which lies flat against the outside surfaces 34 at the junction between the frame members so as to cover that slot. A bead of sealant is provided on either side of the insert member before insertion so that as it is inserted the bead of sealant (not shown) is squeezed onto the underside of the cover portion 65 and on either side of the flange 66 to provide a seal with the adjacent surface 34 of the frame member at the recess.

In FIGS. 1, 4 and 5, the insert member 53 includes a flat cover portion 65 and a single flange 66 with a single bead 67 at its outer end. In an alternative arrangement (not shown) there is a cover portion and two flanges each terminating at its upper end with a bead. This alternative insert member construction can thus accommodate a greater spacing between the frame members to provide the tightening action of the connecting member.

The cross section of FIG. 2 is indicated at the lines 2-2 in FIG. 3. Thus it will be appreciated that the frame members 14, 15 and 16 and particular frame member 14 which is shown in FIG. 2 is of the same profile as the frame member 17. At this location, however, the recesses 38 and 39 are used in an alternative manner from the connecting members of FIG. 1 since there is no connection of the frame member 14 at that location. The same recesses 38 and 39 are therefore used to receive the nailing strip 23 and the finishing plate 24. Thus each of these elements comprises a mounting portion 23A, 24A which is shaped to match approximately one half of the shape of the connecting member 51 so that it can be received into the respective recess as a sliding fit. The provision of a mounting for such elements is previously known but it is not previously known to provide a mounting which is used in a mullion arrangement to provide the connection between the two frame members at the mullion.

The recesses 38, 38A and 39 also provide a receptacle for a screw connection defined by screws 70 to a corner member (not shown) which is inserted into the end of the frame member to connect to the next at the mitered corner. The outer grooves 60 provide a curved surface around the screw head which avoids interference with the screw 70. The mounting and arrangement of such screws and such corner members is well known to a person skilled in this art.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A window or door frame for placement in an opening to be filled in a wail comprising:

a first frame member for placement in the opening;

a second frame member for placement in the opening;

each of the first and second frame members having an inner surface for facing generally at right angles to a plane of the wall inwardly of the opening, an outer surface for facing generally at right angles to the plane of the wall and opposite to the inner surface, a first side surface for facing generally in a direction co-planar with the wall toward a window or door to be supported thereby and a second side surface for facing generally in a direction co-planar with the wall opposite to the front surface;

the first and second frame members being arranged outer surface to outer surface to form a mullion across the opening with the first side surfaces thereof generally coplanar and the second side surfaces thereof generally coplanar;

the outer surface of the first frame member having first and second recesses therein extending longitudinally of the first frame member with the first recess arranged adjacent the first side surface and the second recess arranged adjacent the second side surface;

the outer surface of the second frame member having first and second recesses therein extending longitudinally of the second frame member with the first recess arranged adjacent the first side surface and the second recess arranged adjacent the second side surface;

the first recess of the first frame member being aligned with the first recess of the second frame member and the second recess of the first frame member being aligned with the second recess of the second frame member;

each of the recesses having a mouth at the outer surface which is narrower than a portion of the recess spaced from the outer surface;

a first connecting member arranged to lie along the aligned first recesses with a portion of the first connecting member within the first recess of the first frame member and a portion of the first connecting member within the first recess of the second frame member;

the portions of the first connecting member being arranged to be wider than the respective mouth of the first recesses such that the first connecting member prevents the first and second frame members from being pulled apart;

the portions of the first connecting member being arranged to be shallower than the respective first recess so that the first connecting member is a loose fit in the first recesses when the first and second frame members are directly outer surface to outer surface;

a second connecting member arranged to lie along the aligned second recesses with a portion of the second connecting member within the second recess of the first frame member and a portion of the second connecting member within the second recess of the second frame member;

the portions of the second connecting member being arranged to be wider than the respective mouth of the second recesses such that the second connecting member prevents the first and second frame members from being pulled apart;

the portions of the second connecting member being arranged to be shallower than the respective second recess so that the second connecting member is a loose fit in the second recesses when the first and second frame members are directly outer surface to outer surface;

a first insert member for engagement with the first and second frame members on the first side surfaces thereof at a location thereon at the outer surfaces thereof;

the first insert member having an insert portion for insertion between the outer surfaces of the first and second frame members adjacent the first recesses thereof so as to force the outer surfaces apart and so as to pull the mouths of the first recesses into tight engagement with the respective portions of the first connecting member;

the first insert member having a cover portion covering a junction between the first side surfaces of the first and second frame members;

a second insert member for engagement with the first and second frame members on the second side surfaces thereof at a location thereon at the outer surfaces thereof;

the second insert member having an insert portion for insertion between the outer surfaces of the first and second frame members adjacent the second recesses thereof so as to force the outer surfaces apart and so as to pull the mouths of the second recesses into tight engagement with the respective portions of the second connecting member;

and the second insert member having a cover portion covering a junction between the second side surfaces of the first and second frame members.

2. The frame according to claim 1 wherein a first bead of sealant is placed within the junction between the first side surfaces and covered by the first insert member and a second bead of sealant is placed within the junction between the second side surfaces and covered by the second insert member.

3. The frame according to claim 1 wherein the insert portion of each of the first and second insert members is formed by a single longitudinal web with a wider bead on an end thereof remote from the cover portion.

4. The frame according to claim 1 wherein each of the connecting members has a channel along a face thereof adjacent a base of the respective recess.

5. The frame according to claim 1 wherein the first connecting member has a channel along a face thereof adjacent the junction between the first side walls so as to receive therein an end of the insert portion of the first insert member.

6. The frame according to claim 1 wherein the second connecting member has a channel along a face thereof adjacent the junction between the second side walls so as to receive therein an end of the insert portion of the second insert member.

7. The frame according to claim 1 wherein each of the first recesses is spaced from the first side surfaces by a single wall of the frame member.

8. The frame according to claim 1 wherein each of the second recesses is spaced from the second side surfaces by a single wall of the frame member.

9. The frame according to claim 1 wherein the cover portion of the first insert member forms a flat strip lying flat against the first side surfaces.

10. The frame according to claim 1 wherein the cover portion of the second insert member forms a flat strip lying flat against the side second surfaces.

11. The frame according to claim 1 wherein the first and second frame members each comprise a length of a pultruded hollow profile.

12. The frame according to claim 1 wherein the first frame member comprises a portion of a first frame defined by a plurality of frame members, each of the frame members having a first and a second recess in an outer surface thereof and wherein at least one of the frame members has the first recess thereof arranged to receive a nailing fin carried therein.

13. The frame according to claim 1 wherein the first frame member comprises a portion of a first frame defined by a plurality of frame members, each of the frame members having a first and a second recess in an outer surface thereof and wherein at least one of the frame members has the second recess thereof arranged to receive a sill plate carried therein.

* * * * *